US005868583A

United States Patent [19]

Naitou et al.

[11] Patent Number: 5,868,583

[45] **Date of Patent: *Feb. 9, 1999**

[54] ELECTRICAL CONNECTION BOX

[75] Inventors: Tsutomo Naitou; Tatsuya Hayakawa, both of Yokkaichi, Japan

[73] Assignee: Sumitomo Wiring Systems, Ltd., Yokkaichi, Japan

[ * ] Notice: The term of this patent shall not extend beyond the expiration date of Pat. No. 5,405,035.

[21] Appl. No.: 610,132

[22] Filed: Feb. 29, 1996

[30] Foreign Application Priority Data

Mar. 10, 1995 [JP] Japan ..... 7-051528

[51] Int. Cl.[6] ..... H01R 13/506

[52] U.S. Cl. ..... 439/76.2; 439/701; 439/949

[58] Field of Search ..... 439/76.2, 949, 439/701

[56] References Cited

U.S. PATENT DOCUMENTS

| | | | |
|---|---|---|---|
| 4,371,743 | 2/1983 | Decker . | |
| 5,195,900 | 3/1993 | Kumagai et al. | 439/131 |
| 5,207,591 | 5/1993 | Ozaki et al. | 439/949 |
| 5,372,523 | 12/1994 | Sakatani et al. | 439/552 |
| 5,405,035 | 4/1995 | Kato | 220/3.8 |

FOREIGN PATENT DOCUMENTS

| | | |
|---|---|---|
| 9104428 | 9/1992 | Germany . |
| 7-203615 | 8/1996 | Japan . |
| 1210035 | 10/1970 | United Kingdom . |

*Primary Examiner*—Gary F. Paumen
*Attorney, Agent, or Firm*—Greenblum & Bernstein P.L.C.

[57] ABSTRACT

An electrical connection box includes an upper casing which has a peripheral wall and a locking portion provided on the peripheral wall; a lower casing which has a peripheral wall and a mating locking portion provided on the peripheral wall; wherein the peripheral wall of one of the upper and lower casings is fitted into the peripheral wall of the other of the upper and lower casings such that the electrical connection box is assembled through engagement of the locking portion of the upper casing with the mating locking portion of the lower casing; a bracket engageable portion which is projected from the peripheral wall of the one of the upper and lower casings such that the electrical connection box is mounted on a vehicle body through engagement of the bracket engageable portion with a bracket secured to the vehicle body; and a rib which is provided on the peripheral wall of the other of the upper and lower casings and is inserted into a groove formed on the peripheral wall of the one of the upper and lower casings so as to be enclosed by the peripheral wall of the one of the upper and lower casings.

6 Claims, 9 Drawing Sheets

ELECTRICAL CONNECTION BOX

BACKGROUND OF THE INVENTION

The present invention generally relates to electrical connection boxes and more particularly, to an electrical connection box in which a peripheral wall of one of upper and lower casings is fitted into a peripheral wall of the other of the upper and lower casings and an engageable portion projecting from the upper casing or the lower casing is brought into engagement with a bracket mounted on a panel of a vehicle body such that the electrical connection box is not detached from the bracket even if external force is applied to the bracket by vibrations of the vehicle body, etc.

As shown in FIG. 1 and 2, a known electrical connection box such as a junction box used for connecting wiring harnesses for a motor vehicle to various electric devices includes upper and lower casings 2 and 3 having peripheral walls 2*a* and 3*a*, respectively and a locking claw 2*b* and a groove 3*b* are, respectively, formed on the peripheral walls 2*a* and 3*a* of the upper and lower casings 2 and 3. In a state where an internal circuit such as bus bars 1 is accommodated in the upper casing 2, the peripheral wall 2*a* of the upper casing 2 is fitted into the peripheral wall 3*a* of the lower casing 3 so as to be assembled with the peripheral wall 3*a* of the lower casing 3 such that the upper and lower casings 2 and 3 are locked to each other through engagement of the locking claw 2*b* of the upper casing 2 with the groove 3*b* of the lower casing 3. Meanwhile, as shown in FIG. 2, an engageable portion 3*c* is usually projected from the peripheral wall of the outer casing, i.e., the peripheral wall 3*a* of the lower casing 3 and is brought into engagement with a bracket 5 mounted on a panel 4 of a vehicle body.

In the known electrical connection box of the above described arrangement, when the panel 4 of the vehicle body is vibrated during running of the motor vehicle, external force is applied to the bracket 5 mounted on the panel 4 of the vehicle body, so that an engageable plate portion 5*b* of the bracket 5 is tilted about a fulcrum defined by a fixing portion 5*a* of the bracket 5 as shown in FIG. 3. As a result, the peripheral wall 3*a* of the lower casing 3 is pulled in the direction of the arrow of FIG. 3 through the engageable portion 3*c* held in engagement with the engageable plate portion 5*b* of the bracket 5 and thus, there is such a risk that the locking claw 2*b* of the upper casing 2 is disengaged from the groove 3*b* of the lower casing 3 as shown in FIG. 4.

Meanwhile, since the engageable portion 3*c* is provided on an outer face of the outer casing, large space is required to be provided at a portion of the vehicle body, on which the electrical connection box is mounted, so that space for installing the electrical connection box is increased and thus, it may be difficult to dispose the electrical connection box at a narrow site. Furthermore, if a guide 3*d* for receiving opposite side edges of the engageable plate portion 5*b* of the bracket 5 is provided on the lower casing 3, such a problem arises that the electrical connection box becomes larger in size.

SUMMARY OF THE INVENTION

Accordingly, an essential object of the present invention is to provide, with a view to eliminating the above mentioned disadvantages of the prior art, an electrical connection box which is fixed to a bracket such that upper and lower casings of the electrical connection box are not detached from each other even if external force is applied to the bracket and which is made compact in size such that space for installing the electrical connection box is reduced.

In order to accomplish this object of the present invention, an electrical connection box according to the present invention comprises: an upper casing which has a peripheral wall and a locking portion provided on the peripheral wall; a lower casing which has a peripheral wall and a mating locking portion provided on the peripheral wall; wherein the peripheral wall of one of the upper and lower casings is fitted into the peripheral wall of the other of the upper and lower casings such that the electrical connection box is assembled through engagement of the locking portion of the upper casing with the mating locking portion of the lower casing; a bracket engageable portion which is projected from the peripheral wall of the one of the upper and lower casings such that the electrical connection box is mounted on a vehicle body through engagement of the bracket engageable portion with a bracket secured to the vehicle body; and a rib which is provided on the peripheral wall of the other of the upper and lower casings and is inserted into a groove formed on the peripheral wall of the one of the upper and lower casings so as to be enclosed by the peripheral wall of the one of the upper and lower casings.

In this arrangement of the electrical connection box, the bracket engageable portion is projected from the peripheral wall of the inner casing so as to be brought into engagement with the bracket. Thus, if the bracket is tilted in a direction away from the electrical connection box, i.e., outwardly, the inner casing is pulled outwardly by the bracket so as to urge the inner and outer casings to be further locked to each other. On the contrary, if the bracket is tilted in a direction towards the electrical connection box, i.e., inwardly, the inner casing is also tilted inwardly together with the bracket so as to inwardly push the rib of the outer casing inserted into the groove of the inner casing, so that both the inner and outer casings are tilted inwardly and thus, locking between the inner and outer casings is not cancelled. Furthermore, since the bracket engageable portion is projected from the peripheral wall of the inner casing, the outer shape of the electrical connection box can be made smaller than that of a case in which the bracket engageable portion is projected from the peripheral wall of the outer casing and thus, the electrical connection box can be made more compact, thereby resulting in reduction of space for installing the electrical connection box.

For example, the bracket engageable portion is projected from the peripheral wall of the upper casing and the locking portion of the upper casing and the mating locking portion of the lower casing are disposed below the bracket engageable portion.

By this arrangement of the electrical connection box, since the bracket engageable portion is projected from the peripheral wall of the upper casing acting as the inner casing, the lower casing cannot be fitted around the bracket engageable portion and thus, the locking portion of the upper casing and the mating locking portion of the lower casing are disposed below the bracket engageable portion. Furthermore, since the locking portion and the mating locking portion are disposed below the bracket engageable portion, namely, closer to the vehicle body than the bracket engageable portion is, the amount of deformation of the electrical connection box due to tilt of the bracket is reduced at the locking portions and thus, locking between the upper and lower casings is less likely to be cancelled.

It is preferable that the bracket engageable portion is provided at each of a plurality of sides of the electrical connection box.

By this arrangement of the electrical connection box, since the bracket engageable portion is provided at each of the sides of the electrical connection box, the electrical connection box can be mounted on the bracket in any direction quite efficiently.

Furthermore, it is preferable that an outer surface of the peripheral wall of the lower casing acting as the outer casing is held in contact with the bracket.

By this arrangement of the electrical connection box, since the outer surface of the peripheral wall of the lower casing acting as the outer casing is held in contact with the bracket. Therefore, if the bracket is tilted in the direction towards the electrical connection box, i.e., inwardly, the lower casing is tilted inwardly by the bracket, while the upper casing is also tilted inwardly through engagement of the bracket engageable portion of the upper casing with the bracket. As a result, locking between the upper and lower casings is less likely to be cancelled.

Meanwhile, it is preferable that a pair of the grooves and a pair of the ribs are, respectively, provided at opposite sides of the bracket engageable portion and a pair of the locking portions and a pair of the mating locking portions are, respectively, provided at opposite sides of the bracket engageable portion. For example, a pair of guide portions for receiving opposite side edges of an engageable plate portion of the bracket are provided at opposite sides of the bracket engageable portion, respectively and the groove having an L-shaped sectional shape is provided at each of the guide portions. On the other hand, the rib having an L-shaped sectional shape is provided on the peripheral wall of the lower casing so as to be inserted into the groove.

By this arrangement of the electrical connection box, since a pair of the grooves and a pair of the ribs are, respectively, provided at the opposite sides of the bracket engageable portion and a pair of the locking portions and a pair of the mating locking portions are, respectively, provided at the opposite sides of the bracket engageable portion, external force applied to the electrical connection box through the bracket is received equally at the opposite sides of the bracket engageable portion and thus, locking between the upper and lower casings is less likely to be cancelled.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 8:
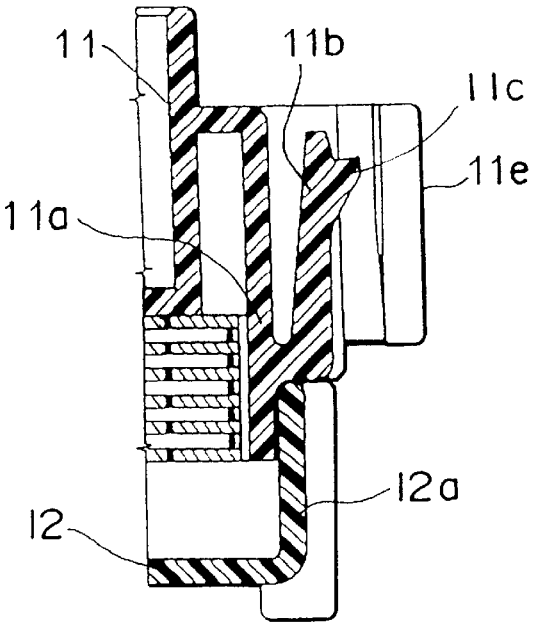
FIGS. 8, 9, 10 and 11 are sectional views taken along the lines VIII—VIII, IX—IX, X—X and XI—XI in FIG. 7, respectively.

Referring now to the drawings, there is shown in FIGS. 5 to 16, a rectangular electrical connection box 10 according to one embodiment of the present invention. As shown in FIG. 8, the electrical connection box 10 includes upper and lower casings 11 and 12 having peripheral walls 11*a* and 12*a* and the peripheral wall 12*a* of the lower casing 12 is fitted around the peripheral wall ll*a* of the upper casing 11 such that the upper and lower casings 11 and 12 act as inner and outer casings of the electrical connection box 10, respectively.

Figure 1:
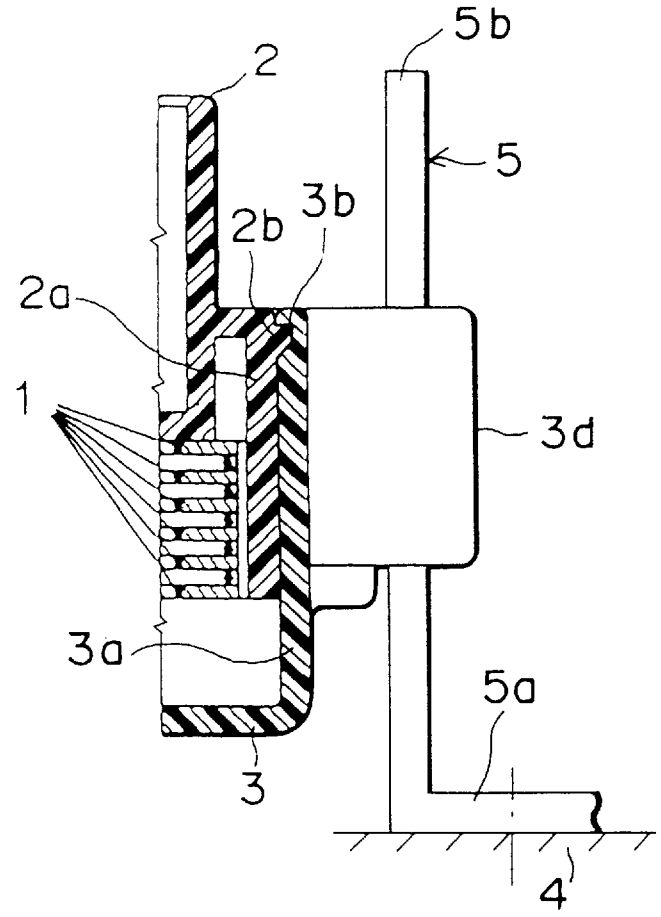
Fig. 1 PRIOR ART
FIGS. 1 and 2 are sectional views of a locking portion and a bracket engageable portion of a prior art electrical connection box (already referred to)
Figure 2:
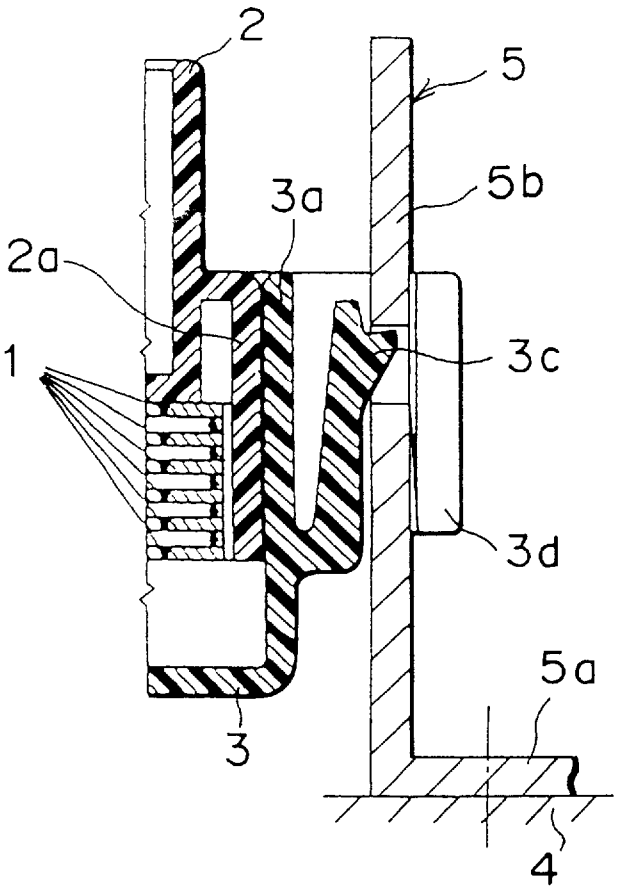
Fig. 2 PRIOR ART
Figure 3:
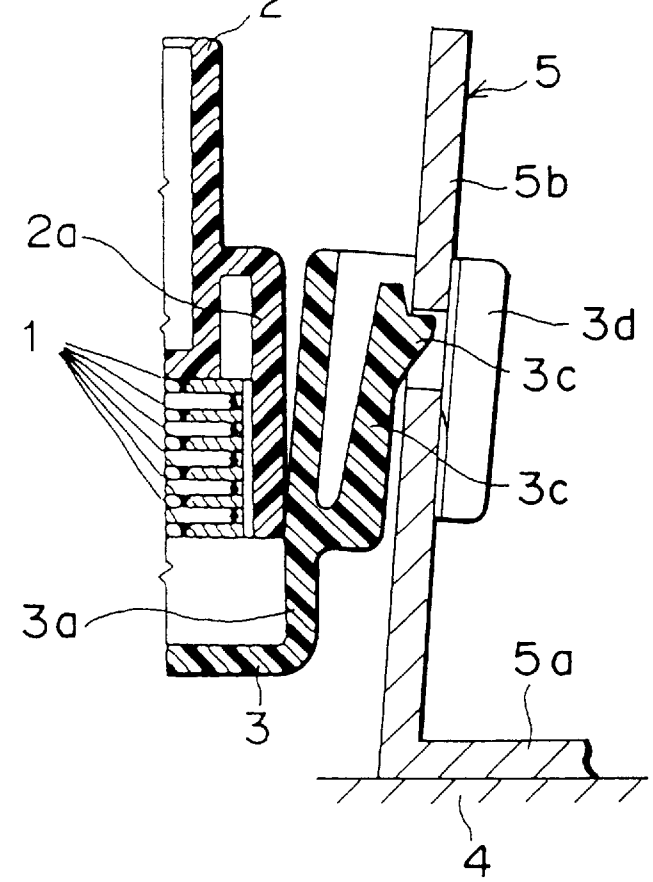
Fig. 3 PRIOR ART
FIGS. 3 and 4 are sectional views showing disadvantages of the bracket engageable portion and the locking portion of the prior art electrical connection box of FIGS. 2 and 1, respectively (already referred to)
Figure 4:
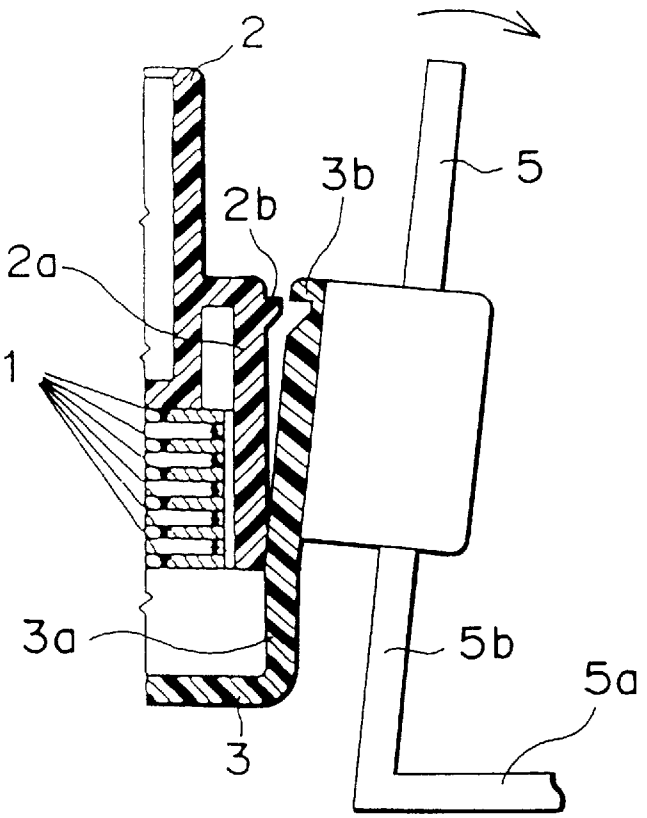
Fig. 4 PRIOR ART
Figure 5:
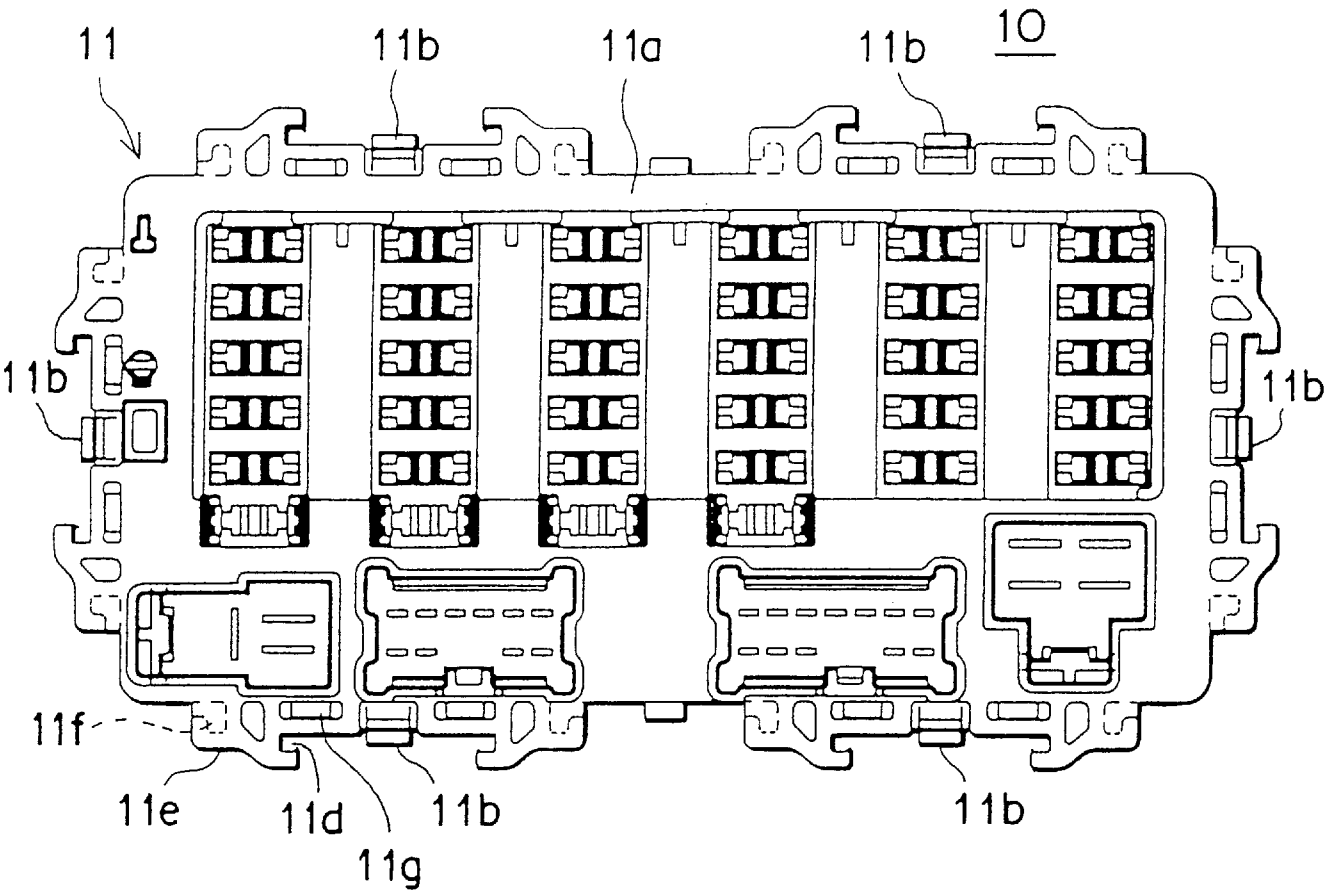
FIG. 5 is a top plan view of an electrical connection box according to one embodiment of the present invention.
Figure 6:
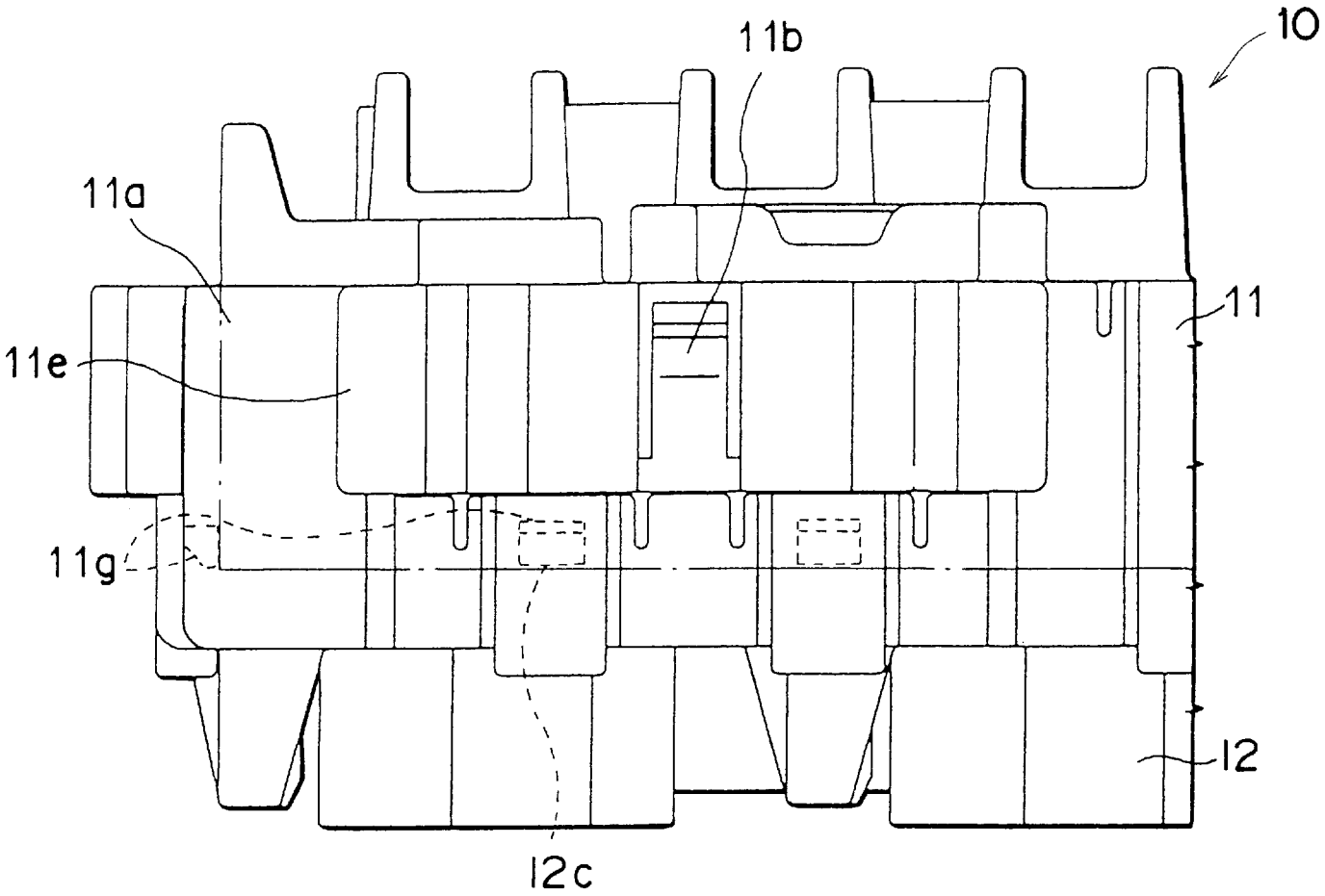
FIG. 6 is an enlarged fragmentary front elevational view of the electrical connection box of FIG. 5.
Figure 7:
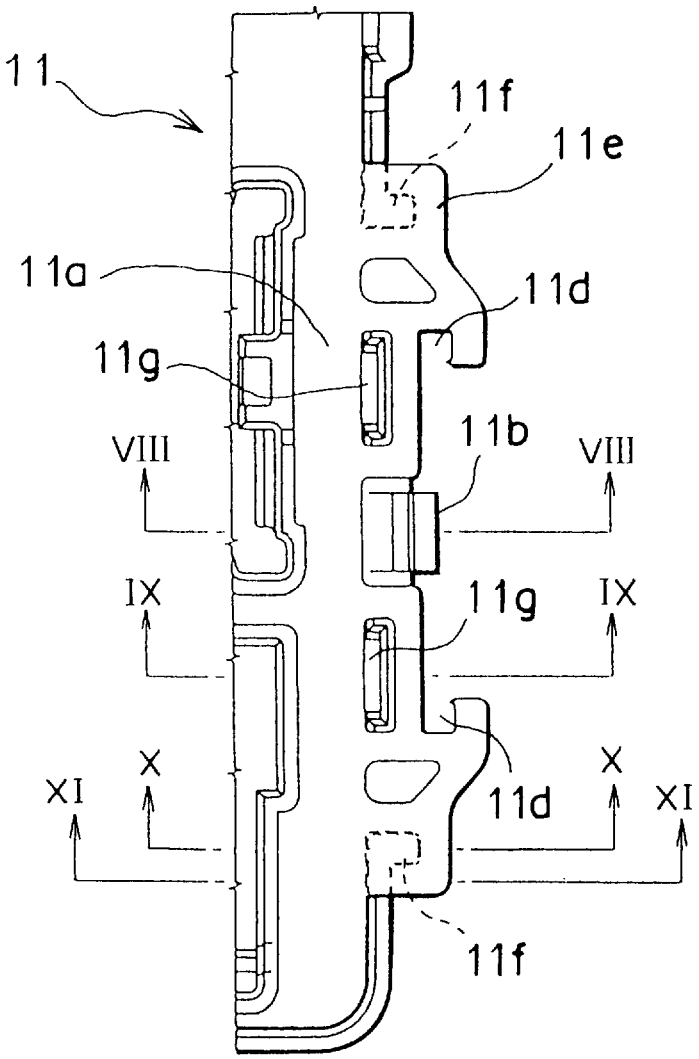
FIG. 7 is an enlarged fragmentary view of FIG. 5.
Figure 12:
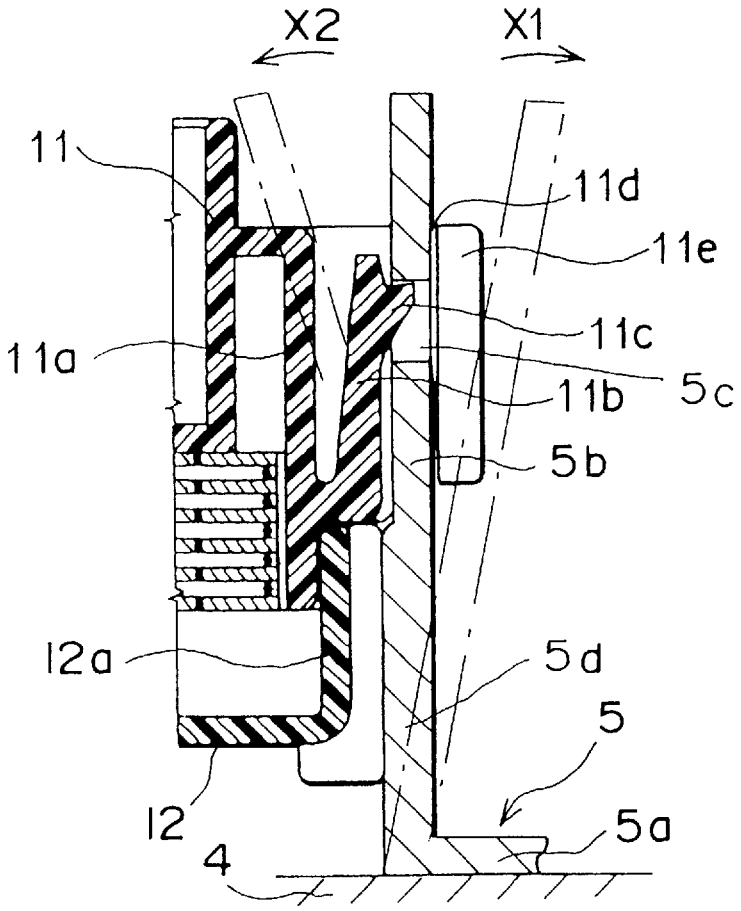
FIG. 12 is a sectional view showing the electrical connection box of FIG. 5 mounted on a bracket.

Furthermore, as shown in FIG. 5, a total of six L-shaped bracket engageable portions 11*b* are projected from four sides of the upper casing 11. Two bracket engageable portions 11*b* are provided at each of opposite longer sides of the upper casing 11, while one bracket engageable portion 11*b* is provided at each of opposite shorter sides of the upper casing 11. As shown in FIG. 12, each of the bracket engageable portions 11*b* is brought into engagement with a bracket 5 mounted on a panel 4 of a vehicle body such that the electrical connection box 10 is fixed to the panel 4 of the vehicle body. The bracket 5 includes a fixing portion 5*a* secured to the panel 4 of the vehicle body and a vertical engageable plate portion 5*b*. Each of the bracket engageable portions 11*b* is projected upwardly from a lower portion of the peripheral wall 11*a* of the upper casing 11 and an engageable claw 11*c* protrudes from an outer face of each of the bracket engageable portions 11*b* in the vicinity of an upper end of each of the bracket engageable portions 11*b*.

Figure 13:
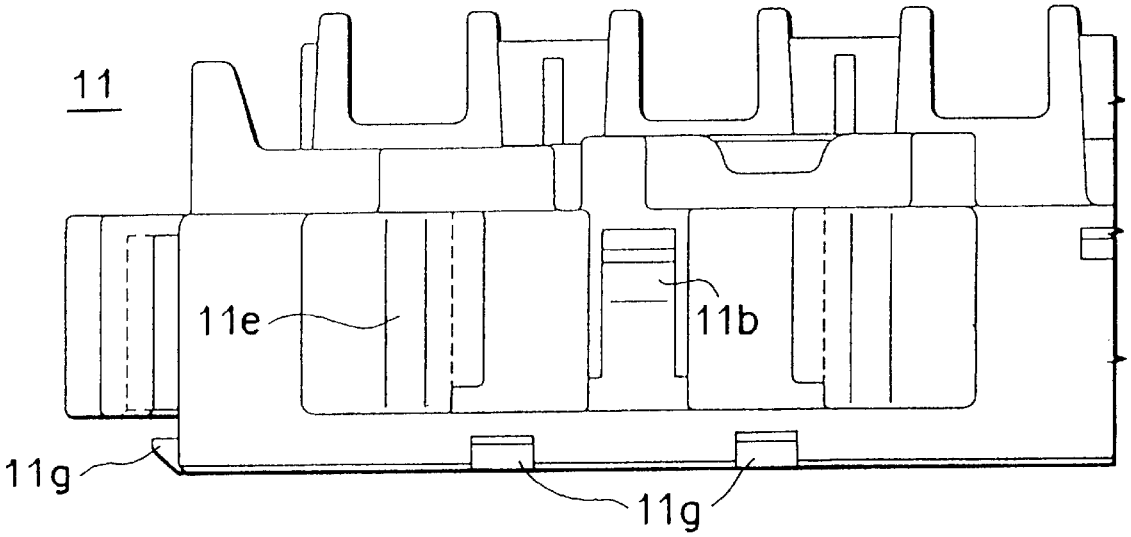
FIG. 13 is a fragmentary top plan view of an upper casing of the electrical connection box of FIG. 5.
Figure 14:
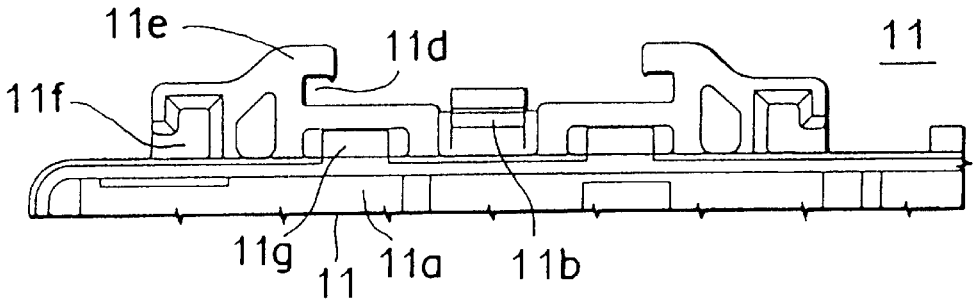
FIG. 14 is a fragmentary bottom plan view of the upper casing of FIG. 13.

As shown in FIGS. 12 to 14, a pair of guide portions 11*e* are, respectively, provided at opposite sides of each of the bracket engageable portions 11*b* so as to extend from the peripheral wall 11*a* of the upper casing 11 and define a pair of substantially U-shaped recesses 11*d* for receiving opposite side edges of the engageable plate portion 5*b* of the bracket 5, respectively. An L-shaped downwardly opening groove 11*f* is formed at each of the guide portions 11*e*. Meanwhile, an outwardly extending locking claw 11*g* is provided between the groove 11*f* and each of the bracket engageable portions 11*b*, namely, at each of opposite sides of the bracket engageable portion 11*b* and along a bottom face of the peripheral wall 11*a* of the upper casing 11.

Figure 15:
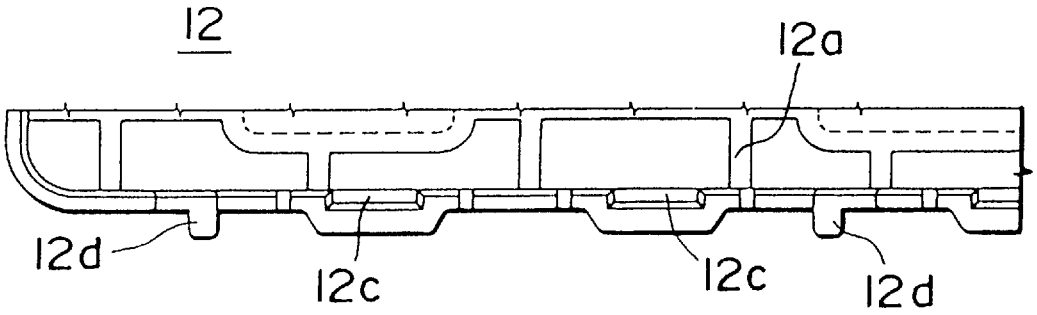
FIG. 15 is a fragmentary top plan view of a lower casing of the electrical connection box of FIG. 5.
Figure 16:
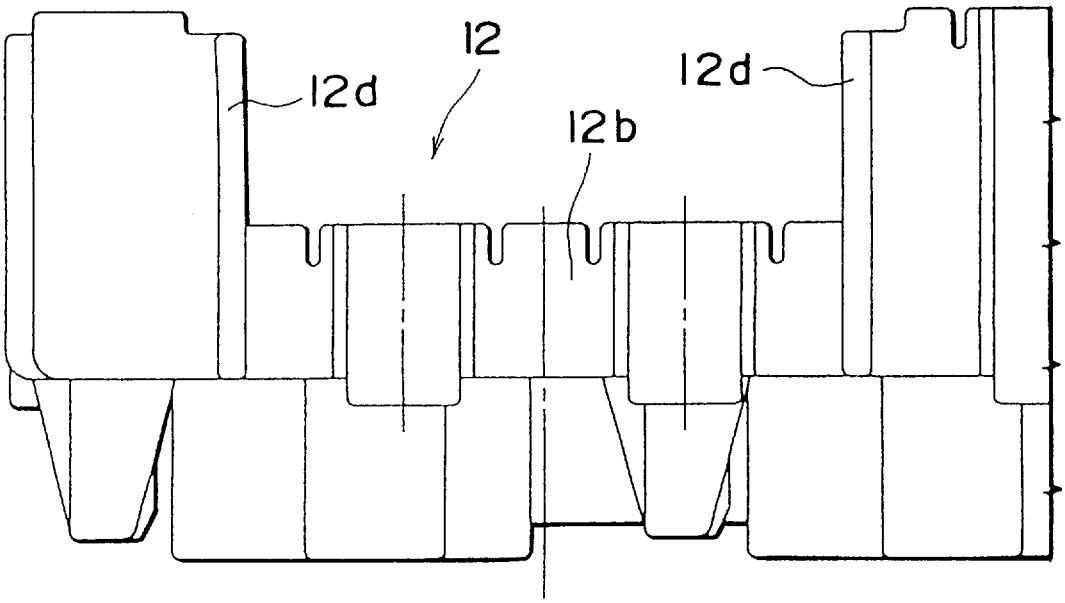
FIG. 16 is a fragmentary front elevational view of the lower casing of FIG. 15.

As shown in FIGS. 15 and 16, portions 12*b* of the peripheral wall 12*a* of the lower casing 12, which correspond to the bracket engageable portions 11*b* of the upper casing 11, respectively, cannot be fitted around the upper casing 11 and thus, are recessed at their upper end portions. A pair of inwardly extending locking claws 12*c* are provided on an upper end of each of the portions 12*b* of the peripheral wall 12*a* of the lower casing 12. Opposite sides of each of the portions 12*b* of the peripheral wall 12*a* of the lower casing 12 are projected upwardly into a pair of L-shaped ribs 12*d* which are, respectively, inserted into the grooves 11*f* of the upper casing 11 from below along an inner side edge of each of the ribs 12*d*.

Figure 9:
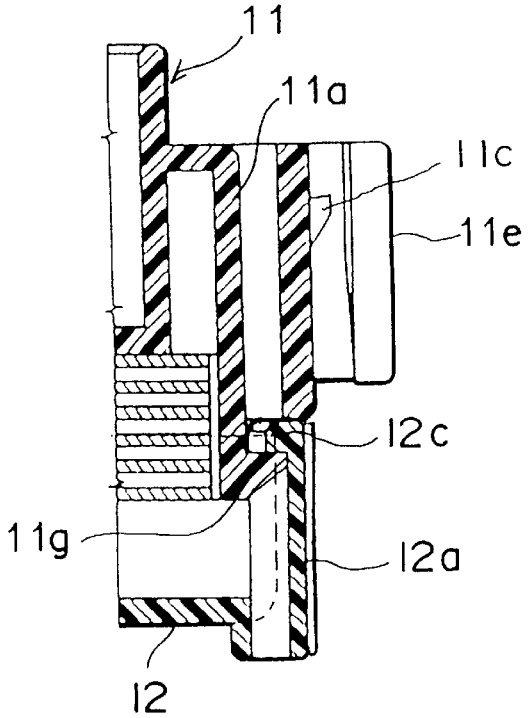
Figure 10:
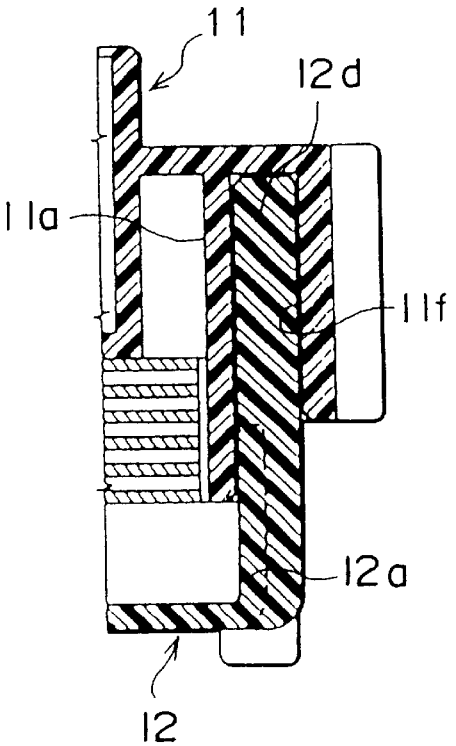
Figure 11:
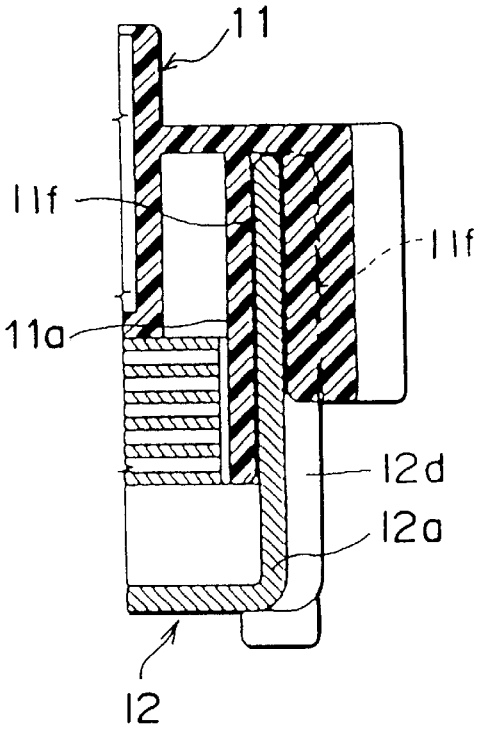

When the upper and lower casings 11 and 12 are assembled with each other, a state shown in FIGS. 6 and 8 to 11 is brought about in which an upper portion of the peripheral wall 12*a* of the lower casing 12 is fitted around a lower portion of the peripheral wall 11*a* of the upper casing 11. At the bracket engageable portion 11*b* of the upper casing 11, an upper end of the peripheral wall 12*a* of the lower casing 12 is disposed below the bracket engageable portion 1l*b* of the upper casing 11 as shown in FIG. 8. Meanwhile, at a locking position for locking the upper and lower casings 11 and 12 to each other, where the locking claws 11*g* of the upper casing 11 and the locking claws 12*c* of the lower casing 12 are held in engagement with each other, the upper end of the peripheral wall 12*a* of the lower casing 12 is disposed below the bracket engageable portion 11*b* of the upper casing 11 as shown in FIG. 9. Furthermore, as shown in FIGS. 10 and 11, the ribs 12*d* of the lower casing 12 are, respectively, fitted into the grooves 11*f* of the upper casing 11, which are disposed outside the bracket engageable portion 11*b* and the locking claw 11*g* such that the ribs 12*d* of the lower casing 12 are enclosed by the peripheral wall 11*a* of the upper casing 11.

When the upper and lower casings 11 and 12 are assembled with each other and the locking claws 11*g* of 12*c* of the upper and lower casings 11 and 12 are brought into engagement with each other such that the upper and lower casings 11 and 12 are locked to each other as described above, the electrical connection box 10 is completed. At this time, the engageable claw 11*c* of the bracket engageable portion 11*b* of the upper casing 11 is brought into engagement with a hole 5*c* formed on the engageable plate portion 5*b* of the bracket 5 as shown in FIG. 12 such that the electrical connection box 10 is mounted on the panel 4 of the vehicle body through the bracket 5. In this state, opposite lower side faces 5*d* of the bracket 5 are held in contact with an outer surface of the peripheral wall 12*a* of the lower casing 12.

In case the electrical connection box 10 of the above described arrangement has been mounted on the bracket 5 through the bracket engageable portion 1l*b*, engagement between the locking claws 1l*g* of the upper casing 11 and the locking claws 12*c* of the lower casing 12 is not cancelled even if the bracket 5 is tilted in the direction of either the arrow X1 or the arrow X2 in FIG. 12 by vibrations of the vehicle body during running of the motor vehicle.

Namely, if the bracket 5 is tilted in the direction of the arrow X1 away from the electrical connection box 10, the upper casing 11 having the bracket engageable portion 11*b* held in engagement with the bracket 5 is pulled in the direction of the arrow X1 by the bracket 5. When external force is applied to the upper casing 11 in the direction of the arrow X1, the upper casing 11 is urged by the bracket 5 to further bring the locking claws 11*g* and 12*c* of the upper and lower casings 11 and 12 into engagement with each other and thus, the upper and lower casings 11 and 12 are further locked to each other.

On the other hand, if the bracket 5 is tilted in the direction of the arrow X2 towards the electrical connection box 10, the upper casing 11 is also tilted in the direction of the arrow X2 through the bracket engageable portion 11*b*. Meanwhile, the ribs 12*d* of the lower casing 12 are, respectively, inserted into the grooves 11*f* of the upper casing 11 so as to be enclosed by the peripheral wall 11*a* of the upper casing 11. Therefore, when the upper casing 11 is tilted in the direction of the arrow X2, the lower casing 12 is also pushed in the direction of the arrow X2 by the peripheral wall 11*a* of the upper casing 11 so as to be tilted in the direction of the arrow X2. Meanwhile, since the peripheral wall 12*a* of the lower casing 12 is held in contact with the engageable plate portion 5*b* of the bracket 5, the peripheral wall 12*a* of the lower casing 12 is pushed in the direction of the arrow X2 by also the bracket 5 so as to be tilted in the direction of the arrow X2. Thus, since the upper and lower casings 11 and 12 are displaced in the same direction, engagement between the locking claws 11*g* and 12*c* of the upper and lower casings 11 and 12 is not cancelled.

As is clear from the foregoing description of the electrical connection box of the present invention, the bracket engageable portion is projected from the peripheral wall of the inner casing so as to be brought into engagement with the bracket. Therefore, if the bracket is tilted in the first direction away from the electrical connection box, the inner casing is also pulled in the first direction by the bracket and thus, the inner casing is further locked to the outer casing. On the contrary, if the bracket is tilted in the second direction towards the electrical connection box, the inner casing is also tilted in the second direction by the bracket, so that the ribs of the outer casing, which are inserted into the grooves of the inner casting, are pushed by the inner casing in the second direction so as to be tilted in the second direction and thus, locking between the inner and outer casings is not cancelled. Accordingly, even if the bracket is tilted in either the first direction or the second direction, it is possible to positively prevent cancellation of locking between the inner and outer casings.

Furthermore, since the bracket engageable portion is projected from the peripheral wall of the inner casing, outer shape of the electrical connection box as a whole can be made smaller than that of a case in which the bracket engageable portion is projected from the peripheral wall of the outer casing and thus, the electrical connection box can be made more compact. Meanwhile, space required for mounting the electrical connection box on the bracket through the bracket engageable portion is lessened, space for installing the electrical connection box can be reduced.

Meanwhile, since the locking portions for locking the inner and outer casings to each other are disposed below the bracket engageable portion, namely, closer to the panel of the vehicle body than the bracket engageable portion is, the amount of deformation of the electrical connection box due to tilt of the bracket is reduced at the locking portions and thus, locking between the inner and outer casings is less likely to be cancelled.

Moreover, since the bracket engageable portion is provided at each of the sides of the electrical connection box, the electrical connection box can be mounted on the bracket through the bracket engageable portion in any direction quite efficiently.

Furthermore, since the inner and outer casings can be positively tilted in the same direction through contact of the inner casing with the bracket, cancellation of locking between the inner and outer casings can be prevented. Meanwhile, since a gap between the bracket and the electrical connection box is eliminated, the electrical connection box can be held stably.

In addition, since a pair of the rib fitting portions and a pair of the locking portions are provided for the inner and outer casings at the opposite sides of the bracket engageable portion, respectively, the inner and outer casings are fixed tight to each other at the opposite sides of the bracket engageable portion. Therefore, even if external force is applied to the electrical connection box through the bracket engageable portion, locking between the inner and outer casings of the electrical connection box can be held positively.

What is claimed is:

1. An electrical connection box comprising:

an upper casing which has a peripheral wall and a locking portion provided on the peripheral wall;

a lower casing which has a peripheral wall and a mating locking portion provided on the peripheral wall;

the peripheral wall of one of the upper and lower casings being fitted into the peripheral wall of the other of the upper and lower casings such that the electrical connection box is assembled through engagement of the locking portion of the upper casing with the mating locking portion of the lower casing;

a bracket engageable portion which projects from the peripheral wall of the one of the upper and lower casings such that the electrical connection box is mounted on a vehicle body through engagement of the bracket engageable portion with a bracket secured to the vehicle body; and a rib being spaced from the locking portion and mating locking portion and provided on the peripheral wall of the other of the upper and lower casings and is inserted into a groove formed on the peripheral wall of the one of the upper and lower casings so as to be enclosed by the peripheral wall of the one of the upper and loser casings, so that the locking portion of the upper casing is prevented from being disengaged from the mating locking portion of the lower casing.

2. An electrical connection box as claimed in claim 1, wherein the bracket engageable portion is projected from the peripheral wall of the upper casing and the locking portion of the upper casing and the mating locking portion of the lower casing are disposed below the bracket engageable portion.

3. An electrical connection box as claimed in claim 1, which has a plurality of sides such that the bracket engageable portion is provided at each of the sides of the electrical connection box.

4. An electrical connection box as claimed in claim 2, which has a plurality of sides such that the bracket engageable portion is provided at each of the sides of the electrical connection box.

5. An electrical connection box as claimed in claim 2, wherein an outer surface of the peripheral wall of the lower casing is held in contact with the bracket.

6. An electrical connection box as claimed in claim 1, wherein a pair of the grooves and a pair of the ribs are, respectively, disposed at opposite sides of the bracket engageable portion and a pair of the locking portions and a pair of the mating locking portions are, respectively, disposed at opposite sides of the bracket engageable portion.

* * * * *

UNITED STATES PATENT AND TRADEMARK OFFICE

CERTIFICATE OF CORRECTION

PATENT NO. : 5,868,583

DATED : February 9, 1999

INVENTOR(S) : T. NAITOU et al.

It is certified that error appears in the above-identified patent and that said Letters Patent is hereby corrected as shown below:

On the title page: Item [75], line 1 (column 1, line 4) "Tsutomo" should be ---Tsutomu---.

Signed and Sealed this

Twenty-ninth Day of February, 2000

*Attest:*

Q. TODD DICKINSON

*Attesting Officer*

*Commissioner of Patents and Trademarks*